US005314085A

United States Patent [19]

Collado Bonet

[11] Patent Number: 5,314,085

[45] Date of Patent: May 24, 1994

[54] CONTAINER AND TAMPER-EVIDENT CLOSURE

[75] Inventor: Jose Collado Bonet, Paterna, Spain

[73] Assignee: Jose Collado Bonet, S.A., Silla, Spain

[21] Appl. No.: 956,725

[22] Filed: Oct. 2, 1992

[30] Foreign Application Priority Data

Oct. 4, 1991 [ES] Spain ..... 9102973

[51] Int. Cl.[5] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 4,157,144 | 6/1979 | Weiler et al. | 215/252 |
| 4,436,212 | 3/1984 | Alejandro Llera | 215/252 |
| 4,592,476 | 6/1986 | Yasada | 215/252 |
| 4,609,115 | 9/1986 | Moore et al. | 215/252 |
| 4,638,917 | 1/1987 | Persch | 215/252 |
| 4,715,506 | 12/1987 | McLaren | 215/252 |
| 4,771,904 | 9/1988 | Perne et al. | 215/252 |
| 5,115,932 | 5/1992 | Schneider | 215/252 |

*Primary Examiner*—Allan N. Shoap
*Assistant Examiner*—Vanessa Caretto
*Attorney, Agent, or Firm*—Darby & Darby

[57] ABSTRACT

A container with a threaded neck and a non-spin threaded top and ring seal device. The top and the ring seal are frangibly attached. The neck has an upper zone with a helical thread and lower smooth zone with a diameter larger than the upper zone. Between the upper and lower zones is a serrated edge with teeth having oblique upper surfaces for easy insertion/assembly of the top and ring seal. Above the serrated edge there is an annular projection which defines an oblique annular tooth which holds the ring seal in place after the seal is broken, preventing it from coming out of place when the product within the container is being used. There is also another annular projection below the serrated edge near the bottom of the lower zone which centers the ring seal but does not prevent it from dropping when the seal is broken.

2 Claims, 3 Drawing Sheets

CONTAINER AND TAMPER-EVIDENT CLOSURE

PURPOSE OF THE INVENTION

The present invention, as explained in the introduction to this descriptive report, refers to a container with tamper-evident closure, which embodies a number of relevant and advantageous characteristics compared with those which are at present used for this same purpose.

The objective which the invention pursues is centered on the fact that when the seal is broken, the handling is clearly visible, and this handling cannot be concealed in a fraudulent action.

The invention is also designed to achieve that once the top has been unscrewed the ring is located at the neck of the container or bottle, such that, when the contained is tipped up to use the product which it contains, the ring cannot fall off because in some cases this may be incompatible and particularly with those products such as eye washes or liquids for keeping contact lenses, which are applied directly to the eyes.

ANTECEDENTS OF THE INVENTION

There is today among manufacturers of containers and packs, an overruling search to find an inviolable top which can tell the user at any time whether the product which it contains has previously been handled.

The solution has followed a common line, but with different end results, such as those which are described below:

The seal is secured to the top via the breaking points and when it is unscrewed the seal is detached from the top upon finding it impossible to turn with it, precisely because the washer of the seal and the bottleneck include tooth-like swivel-proof devices. After breaking these ribs which join the washer seal to the rest of the top, the ring seal drops down showing that the pack has been used. This seal may leave the bottleneck after the pack has been opened and when this is tipped to use the product which it contains inside. This ring which falls becomes an undesirable element or at least an annoying one which is generally incompatible with the use of the pack, as in the case mentioned above when the product is for ocular use.

In other cases, when the ring seal is detached, it does not fall off and consequently is more or less held in the same position, and so when the top is tightened again, the small separation which might be present after breaking the seal is very well concealed, and it might even not be possible to detect that the pack has been used.

DESCRIPTION OF THE INVENTION

The bottle or container with a tamper-evident closure, which forms the object of this invention, has the fundamental characteristic to achieve the advantages which are listed at the beginning of this descriptive report that it combines with the serrated edge on the bottleneck or container to prevent the seal from turning, the provision of a contiguous plate whose structure will allow the passage of the seal during assembly but will not allow reverse passage after assembly, and where the ring of the seal drops to the lower part of the neck of the bottle or container, showing that it has been handled. When the container is tipped to pour out its contents, the ring seal is not moved beyond that plate because the radial appendages that are found inside it, will act as a check on that plate.

The anti-swivel devices of the ring seal, to prevent this from turning with the actual top, in the unscrewing direction, because they do allow it to turn the opposite way to how it is closed, are executed by a serrated edge at the base of the neck of the bottle or container, at the end of an smooth wide neck which is contiguous to the body of the container, where the ring seal will later be located, after the seal is broken. The ring seal furthermore includes some appendages on the inner side which have a slight deviation which makes it possible to bend them during the unscrewing process, preventing them from turning in the opposite direction because these appendages are fitted at the front of the serrated edge of the bottle neck or container.

The characteristic of the bottleneck or container, which has been explained in the description, is because the neck of the bottle or container is longer than usual and it has two different diameters on the surface of which there are parts which work complimentarily to those that are found in the actual top. We therefore find a smooth lower part in the prolongation of the body of the bottle or container, followed by the serrated edge and plate which checks the ring seal. The end part of the neck includes the helical thread to screw the top which is also a screwed top.

Another essential characteristic which the bottleneck or container embodies is determined by the fact that the serrated edge which defines the non-turn devices of the ring seal, is affected by an oblique machining or downward ramp at the head of the teeth, which eliminates the upper sides. This machining facilitates the entry of the radial appendages which are present in the seal, when the top is being screwed tight, thus preventing these appendages from breaking during the insertion.

To ensure tat the seal does not come out, as yet another improvement of the invention, in the zone which is defined by the wide smooth neck or area where the neck starts, there is another small plate or annular rib which is situated at a paracentral level.

This plate centers the ring of the seal, preventing it from falling to one side excessively and being able to emerge from the upper or main plate.

For an easier understanding of the characteristics of the invention and forming an integral part of this descriptive report, some sheets of plans are attached and in these figures, in an illustrative but not a restrictive way, the following has been shown:

DESCRIPTION OF THE PREFERRED FORM OF EXECUTION

Figure 1:
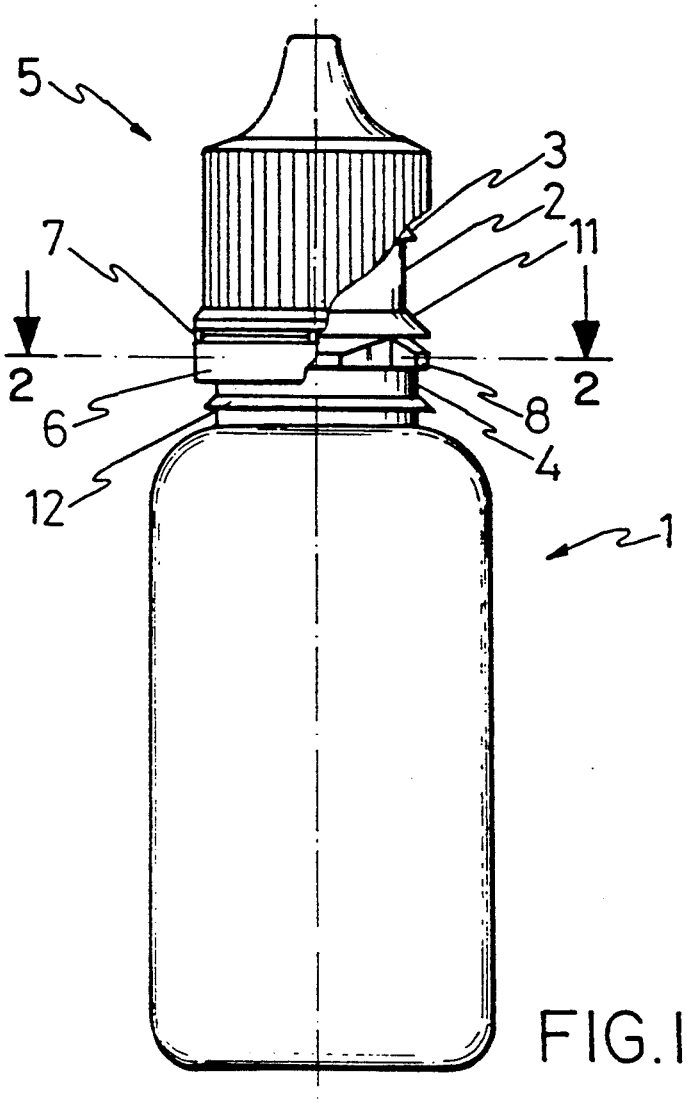
FIG. 1.- This is an elevation view of the container with a tamper-evident closure which is the object of the invention, where the actual seal is fitted to the neck of the container and in the "seal" position; this figure, also shows a sectioned portion to make the inter-connection of the seal and container clearer.
Figure 2:
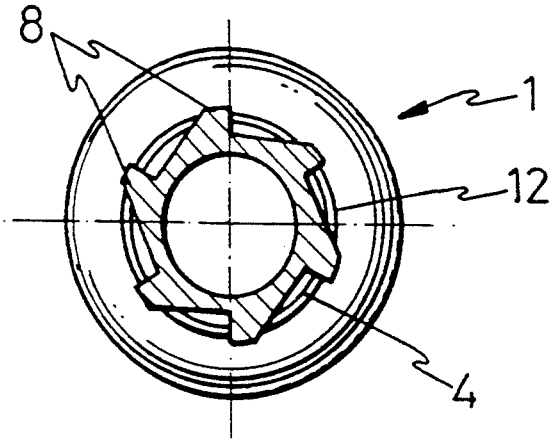
FIG. 2.- This is a section along the line 2—2 of FIG. 1.
Figure 4:
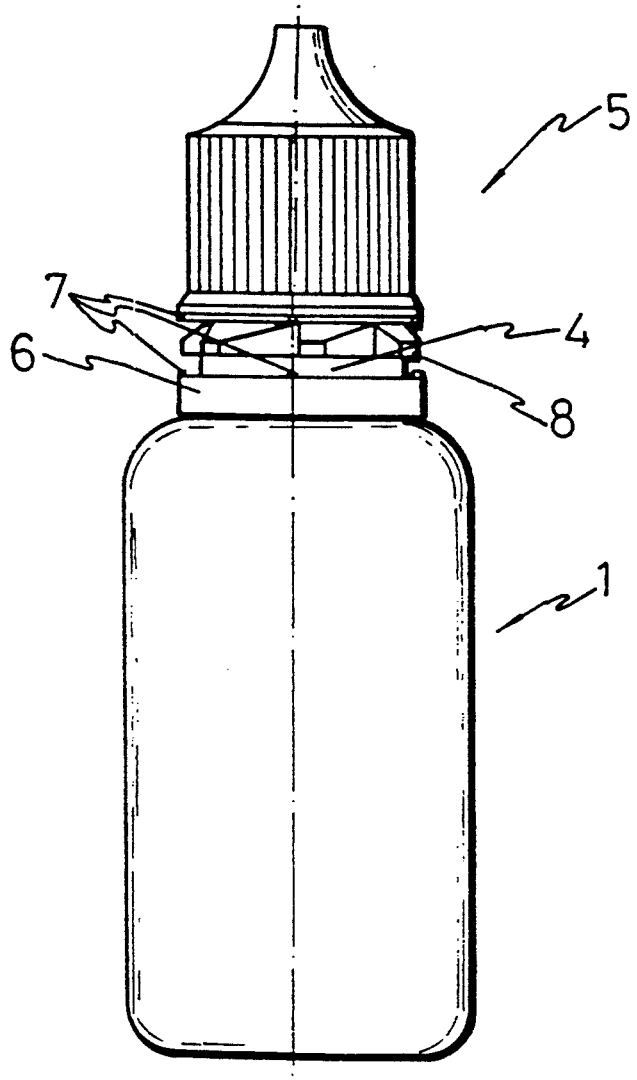
FIG. 4.- This is a similar view to FIG. 1, showing the seal which has dropped, evidencing that it has been handled.

Referring to the numeration which has been adopted in the figures, we can see how the container with a tamper-evident closure, which forms the object of the invention, manages to reach the characteristic of showing that it has visibly been handled because on the neck of the container (1) there is an upper zone (2) which has a screwed thread (3), which is axially detached from the lower zone (4) which has a larger diameter, such that when the actual top (5) is in a closed position, as shown in FIG. 1, the ring seal (6) which exists in a known manner in the prolongation of the lower edge of the top and joined by a number of detachable ribs (7), has its lower edge at quite a distance from the body of the container (1). When the top (5) is unscrewed then, the ring seal (6) drops until it lies on the body of the container (1), and is therefore quite remote from its original position to thus show that it has been handled, even though the top (5) has again been screwed on the neck of the pack (1). If the ring of the seal (6) is lifted to try and hide the fact that the seal has been broken, this operation will prove impossible because there is no way of securing it in this position and consequently it will drop again easily, as shown in FIG. 4.

Figure 3:
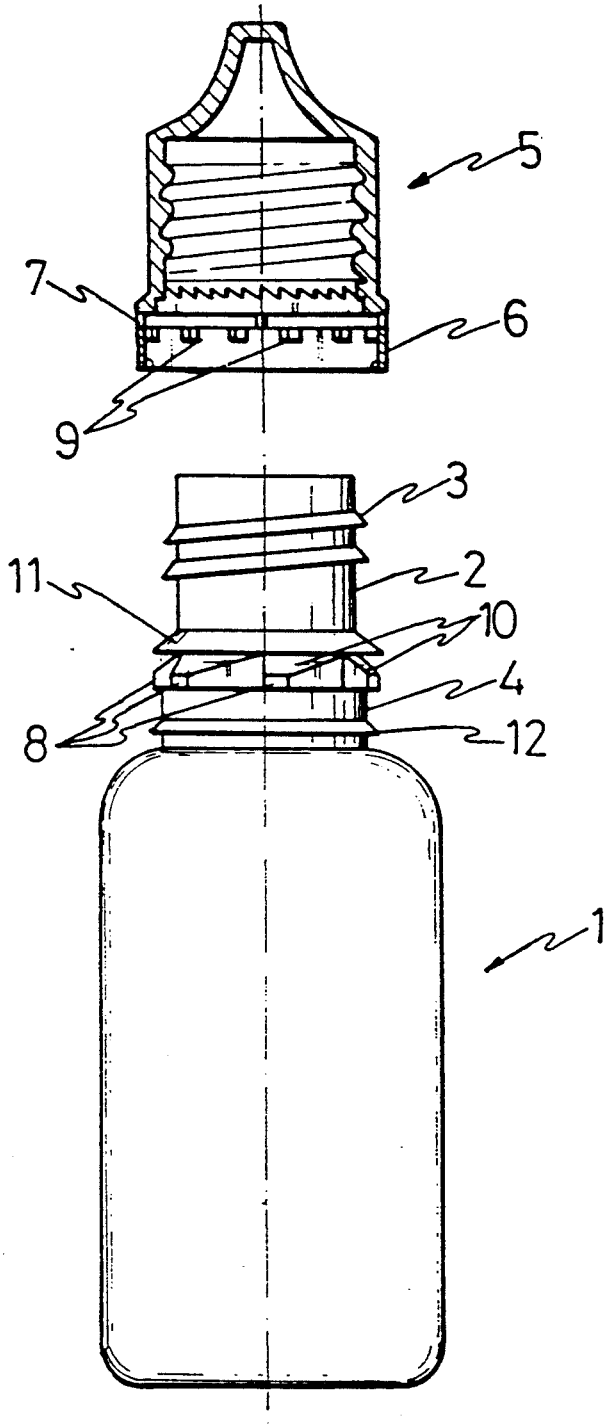
FIG. 3.- This is an exploded view, with the top sectioned, of the invention as shown in FIG. 1.

As can be clearly seen in FIG. 3, between the upper portion (2) of smaller diameter and the lower one (4), the neck of the container (1) has a serrated edge (8) which connects with the appendages (9) which are generally radial ones and which emerge in an oblique form from inside the ring of the, seal (6), and consequently adopt a position which is actually angularly displaced from the radial direction. This inclination allows the operation of inserting the top to be correctly achieved, but without allowing the ring of the seal (6) to turn in the direction that the top is unscrewed (5).

All the teeth which form the serrated edges (8) also have a machining (10) at the top, which helps to facilitate the entry of the radial appendages (9) whilst the top is being applied.

With this structure which we have discussed until now, it has been found that it is possible for the seal (6) to emerge from the neck when the product which is contained in the container is applied, such as the case of, eyewash or liquid for keeping contact lenses, where the container must be tilted to pour out the product in drops.

In this case, the fact that this ring seal (6) can come out of the neck, implies a risk or at least an indisputable discomfort when applying the product, as we have already said. To avoid this, the invention foresees a plate (11) which is immediately above the serrated edge (8), defining an annular projection which has a rectangular and a triangular section and with the hypotenuse turned downwards to form a downward ramp which allows the ring seal to pass (6) when the top (5) is being inserted. This plate (11) checks that this ring seal (6) does not fall out when the container is tipped up (1), because the oblique appendages (9) which are found inside this ring seal (6) fall on it. This assures that when some of these oblique appendages (9) exceed the area which is occupied by the serrated edge (8), the plate (11) is not overrun.

As another improvement of the invention, the possibility has been foreseen that the ring of the seal (6) can be tilted exaggeratedly in respect of the longitudinal shaft of the container (1) and that the oblique appendages (9) of the guarantee seal (6) can remount the plate (11) when that ring seal (6) occupies a position that is axially off-center, the consequence of which would be the fall or emergence of that ring seal (6). To prevent this from happening, the flat and biggest diameter zone (4) of the neck of the container (1), shows at a para-central level, another small plate (12) to prevent the ring seal (6) from becoming too off-center and at the same time tilting more than it would if there were no additional plate (12).

Consequently, with the main plate (11) and this additional plate (12), both being on the neck of the container (1), the ring of the seal (6), once the top (5) has been unscrewed, cannot come out just by the action of gravity, when the container (1) is tipped to use the product which is contained inside it.

We claim:

1. A container and top having a ring seal, said ring seal is frangibly attached to said top and provides visible indication of tampering, said container having an opening in a generally upward direction, said container, top and ring seal comprising:

a neck of said container having an upper zone with a helical screw and a lower zone which is axially separated from said upper zone, said lower zone is smooth and has a larger diameter than said upper zone;

a serrated edge between said upper and lower zones, said serrated edge having teeth;

radial appendages on an inside surface of said ring seal, said radial appendages abutting said teeth of said serrated edge when said top and ring seal are installed on said container, said teeth of said serrated edge permitting said top and said ring seal to be turned in one direction, but resist turning of said top and said ring seal in the opposite direction;

a first annular projection on said neck above said teeth of said serrated edge, said first annular projection defining an oblique collar which permits passage of said ring seal when said top is being installed on said container, but which prevents reverse passage of said ring seal after installation, said first annular projection being above said ring seal after said top is installed on said container; and a second annular projection on said lower zone of said neck, said second annular projection abutting said ring seal after said frangible attachment of said ring seal and said top is broken.

2. A container and top having a ring seal in accordance with claim 1, wherein said teeth of said serrated edge have oblique upper surfaces facilitating passage of said radial appendages when said top and said ring seal are being installed on said container, said oblique surfaces preventing breakage of said frangible attachment of said top and said ring seal.

* * * * *